US009213298B2

(12) United States Patent
Nakatani

(10) Patent No.: US 9,213,298 B2
(45) Date of Patent: Dec. 15, 2015

(54) IMAGE FORMING APPARATUS AND ELECTRIC CHARGE ELIMINATING METHOD

(71) Applicant: KYOCERA Document Solutions Inc., Osaka-shi, Osaka (JP)

(72) Inventor: Takanobu Nakatani, Osaka (JP)

(73) Assignee: KYOCERA Document Solutions Inc., Osaka-shi (JP)

( * ) Notice: Subject to any disclaimer, the term of this patent is extended or adjusted under 35 U.S.C. 154(b) by 0 days.

(21) Appl. No.: 14/289,508

(22) Filed: May 28, 2014

(65) Prior Publication Data

US 2014/0356013 A1 Dec. 4, 2014

(30) Foreign Application Priority Data

May 31, 2013 (JP) ..... 2013-114873

(51) Int. Cl.
*G03G 15/00* (2006.01)

(52) U.S. Cl.
CPC ..... *G03G 15/80* (2013.01); *G03G 15/5004* (2013.01)

(58) Field of Classification Search
CPC ..... G03G 15/5004; G03G 15/80
USPC ..... 399/88
See application file for complete search history.

(56) References Cited

U.S. PATENT DOCUMENTS

| | | | | |
|---|---|---|---|---|
| 3,705,289 | A * | 12/1972 | Szostak et al. | 219/216 |
| 6,661,123 | B2 * | 12/2003 | Hsu | 307/141 |
| 2006/0125904 | A1 * | 6/2006 | Shokai | 347/108 |
| 2012/0134190 | A1 * | 5/2012 | Lee et al. | 363/100 |

FOREIGN PATENT DOCUMENTS

| | | | |
|---|---|---|---|
| JP | S5778236 | U | 5/1982 |
| JP | 03154880 | A | 7/1991 |
| JP | 09128177 | A | 5/1997 |
| JP | 20000122487 | A | 4/2000 |
| JP | 2004361541 | A | 12/2004 |

* cited by examiner

*Primary Examiner* — David Gray
*Assistant Examiner* — Michael Harrison
(74) *Attorney, Agent, or Firm* — Alleman Hall McCoy Russell & Tuttle LLP

(57) ABSTRACT

An image forming apparatus includes a power supply portion, a driving portion, a detection portion, and a control portion. The power supply portion is connected to an external power supply and configured to generate a DC voltage. The driving portion is configured to drive with, as power, the DC voltage generated by the power supply portion. The detection portion is configured to detect a cut-off state of the external power supply with respect to the power supply portion. The control portion is configured to perform control so as to drive the driving portion when the cut-off state of the external power supply is detected by the detection portion.

4 Claims, 6 Drawing Sheets

IMAGE FORMING APPARATUS AND ELECTRIC CHARGE ELIMINATING METHOD

INCORPORATION BY REFERENCE

This application is based upon and claims the benefit of priority from the corresponding Japanese Patent Application No. 2013-114873 filed on May 31, 2013, the entire contents of which are incorporated herein by reference.

BACKGROUND

The present disclosure relates to an image forming apparatus and an electric charge eliminating method.

In order to improve user's convenience, some types of image forming apparatuses (copiers, printers, facsimiles, multifunction peripherals obtained by combining the functions of these apparatuses, etc.) are configured such that a current is applied to a portion of a substrate merely when a power cord connected to an outlet is inserted into an apparatus main body, even without switching a main power switch to an ON state. This is, for example, for enabling reception of transmitted data in an image forming apparatus having a communication function even when the image forming apparatus enters a sleep state (a low power consumption state).

In addition, a technology has been known in which a printer apparatus is powered off on the basis of information from a host device installed at a location away from the printer apparatus. Specifically, the following technology has been disclosed. When a power-off instruction is received from the host device, an off signal is transmitted to a power switch that is provided in the printer apparatus and has an electromagnetic reset function. Then, when the printer apparatus is not powered off, an off signal is transmitted again. When the printer apparatus is not powered off even if the power-off process is performed a predetermined number of times, an alarm signal is transmitted to the host device, and driving of a fixing unit or the like that operates at a high voltage is stopped.

SUMMARY

An image forming apparatus according to one aspect of the present disclosure includes a power supply portion, a driving portion, a detection portion, and a control portion. The power supply portion is connected to an external power supply and configured to generate a DC voltage. The driving portion is configured to drive with, as power, the DC voltage generated by the power supply portion. The detection portion is configured to detect a cut-off state of the external power supply with respect to the power supply portion. The control portion is configured to perform control so as to drive the driving portion when the cut-off state of the external power supply is detected by the detection portion.

An electric charge eliminating method according to another aspect of the present disclosure is an electric charge eliminating method for eliminating electric charge from an image forming apparatus configured to form an image on a recording medium and includes a first step and a second step. In the first step, a cut-off state of an external power supply with respect to a power supply portion configured to generate a DC voltage is detected. In the second step, control is performed so as to drive a driving portion configured to drive with, as power, the DC voltage generated by the power supply portion, when the cut-off state of the external power supply with respect to the power supply portion is detected in the first step.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

Hereinafter, image forming apparatuses and electric charge eliminating methods according to embodiments of the present disclosure will be described in detail with reference to the drawings. It should be noted that hereinafter, the case where the image forming apparatus is a multifunction peripheral will be described as an example.

[First Embodiment]

Figure 1:
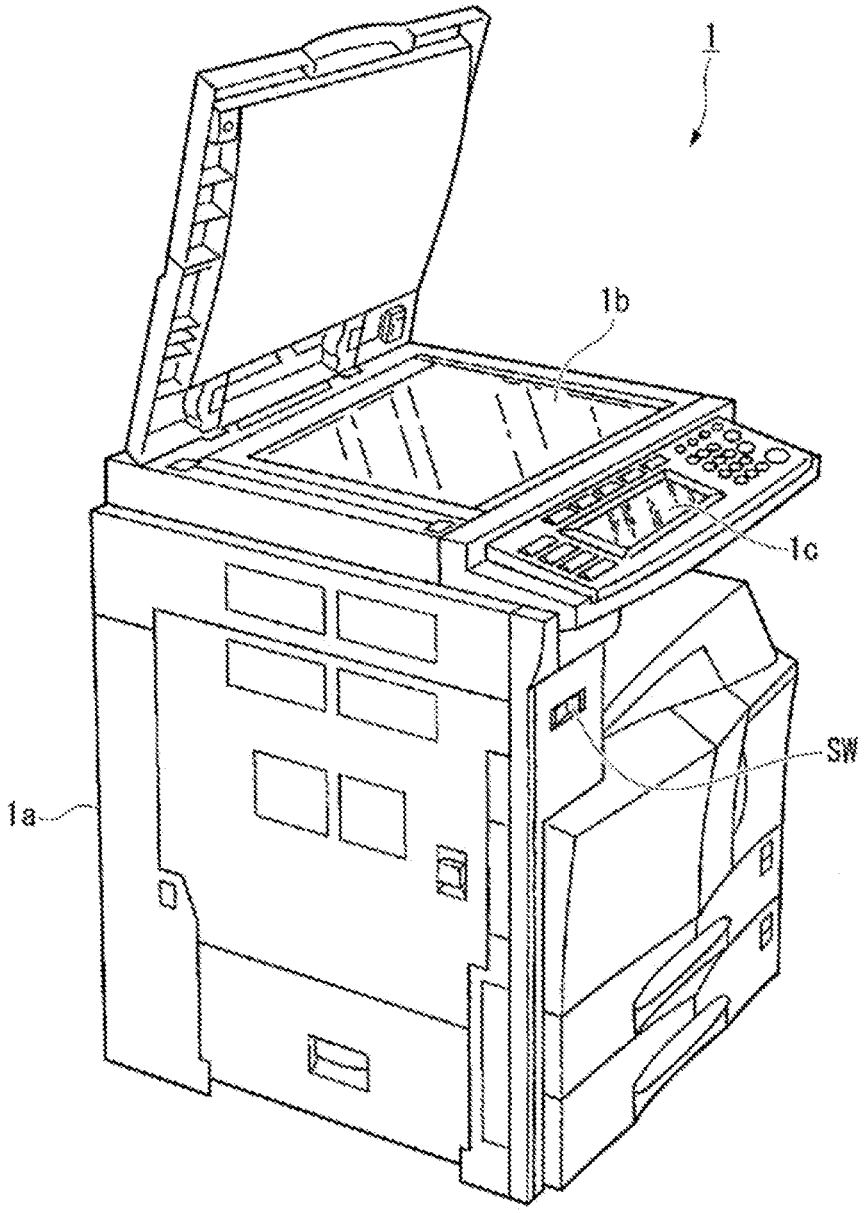
FIG. 1 is a perspective view of a multifunction peripheral as an image forming apparatus according to a first embodiment of the present disclosure.

FIG. 1 is a perspective view of a multifunction peripheral as an image forming apparatus according to a first embodiment of the present disclosure. As shown in FIG. 1, the multifunction peripheral 1 includes a main body portion 1*a*, a scanner portion 1*b*, an operation display panel 1*c*, and the like. The multifunction peripheral 1 has a copy function, a print function, and a facsimile transmission/reception function. The multifunction peripheral 1 is configured to allow an ADF (automatic document feeder) that is used at the scanner portion 1*b*, a sheet feed cassette that contains paper sheets as recording media, and various option devices (extension devices), such as a finisher capable of performing a stapling process, a punching process, and the like, to be mounted thereon.

Incidentally, there is the problem that when such an image forming apparatus is in a sleep state, if power supply to the image forming apparatus is stopped, for example, by pulling out a power cord therefrom, it takes time until electric charge remaining within the image forming apparatus is eliminated (disappears). In contrast, when the image forming apparatus is in a normal operation state, if power supply to the image forming apparatus is stopped, for example, by pulling out the power cord therefrom, it is also conceivable that a load is made greater than that when the image forming apparatus is in the sleep state, but electric charge still remains within the image forming apparatus. In addition, if power supply to the image forming apparatus is stopped during operation of the image forming apparatus, it is also conceivable that a cooling system provided within the image forming apparatus is stopped, the temperature of a semiconductor device (e.g., a control IC) provided within the image forming apparatus is increased, and the semiconductor device may be broken. Furthermore, for example, if the power cord is pulled out when a main power switch is in an ON state, a secondary problem also arises that when the power cord is inserted into an apparatus main body next time, the image forming apparatus starts up immediately so that power is wastefully consumed. In contrast, in the multifunction peripheral 1 according to the present embodiment, when power supply is stopped, electric charge remaining within the apparatus is quickly eliminated, and further cooling within the apparatus is continued.

A main power switch SW (power switch) of the multifunction peripheral 1 is provided on a front surface of the main body portion 1*a* of the multifunction peripheral 1. The main power switch SW is a seesaw switch which is switchable between an ON state and an OFF state by an operation of a user. For example, the main power switch SW becomes the ON state when one end side thereof is pressed by the user. In addition, the main power switch SW becomes the OFF state when the other end side thereof is pressed by the user. Furthermore, although details will be described later, the main power switch SW is also switchable from the ON state to the OFF state by internal control of the multifunction peripheral 1. It should be noted that the main power switch SW does not necessarily need to be provided on the front surface of the main body portion 1*a* and may be provided on a side surface or a back surface of the main body portion 1*a*.

Figure 2:
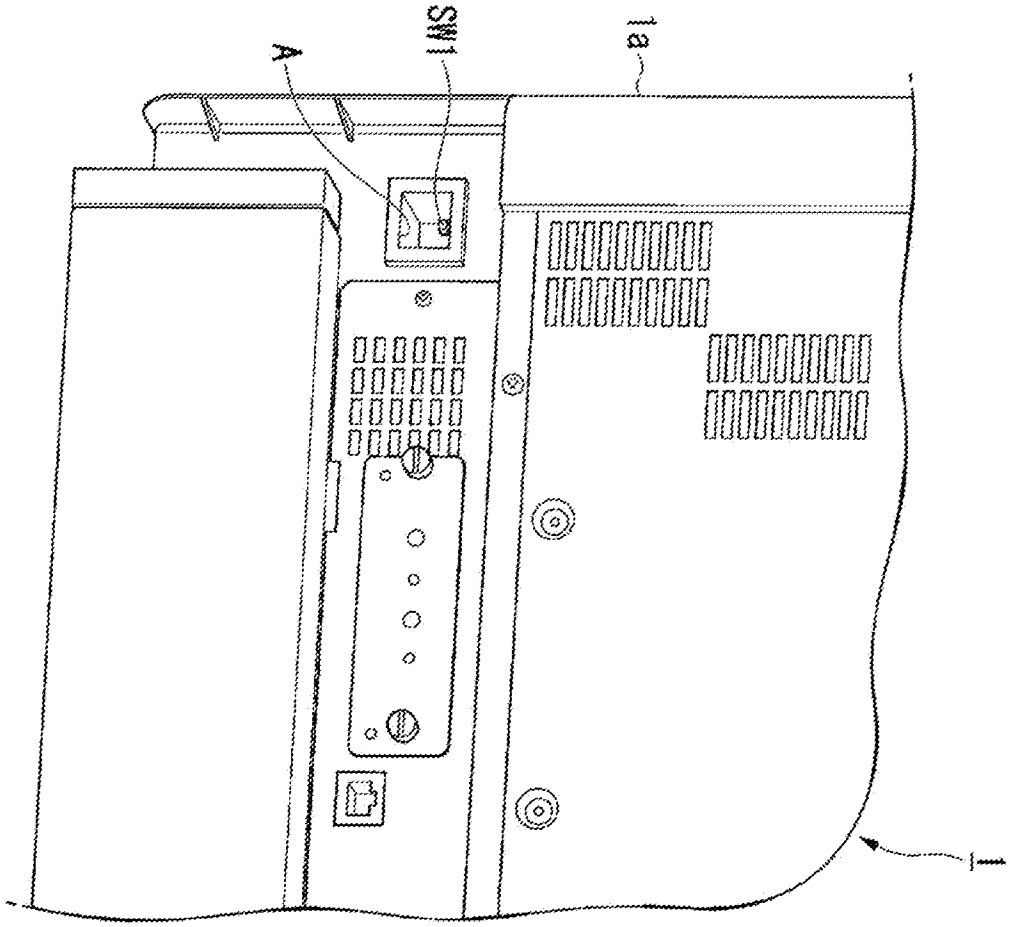
FIG. 2 is a back view of the multifunction peripheral as the image forming apparatus according to the first embodiment of the present disclosure.

FIG. 2 is a back view of the multifunction peripheral as the image forming apparatus according to the first embodiment of the present disclosure. It should be noted that in FIG. 2, for easy understanding, only a part of the back surface of the main body portion 1*a* of the multifunction peripheral 1 is shown. As shown in FIG. 2, the back surface of the main body portion 1*a* is provided with an insertion slot A (insertion portion) into which a power cord CD (see FIG. 3) is inserted. A detection switch SW1 (detection portion) that detects insertion/non-insertion of the power cord CD with respect to the insertion slot A is provided within the insertion slot A. The detection switch SW1 is a push switch. For example, the detection switch SW1 becomes an OFF state when the power cord CD is not inserted into the insertion slot A. In addition, the detection switch SW1 becomes an ON state when the power cord CD is inserted into the insertion slot A. It should be noted that the insertion slot A may be provided in a side surface of the main body portion 1*a*.

Figure 3:
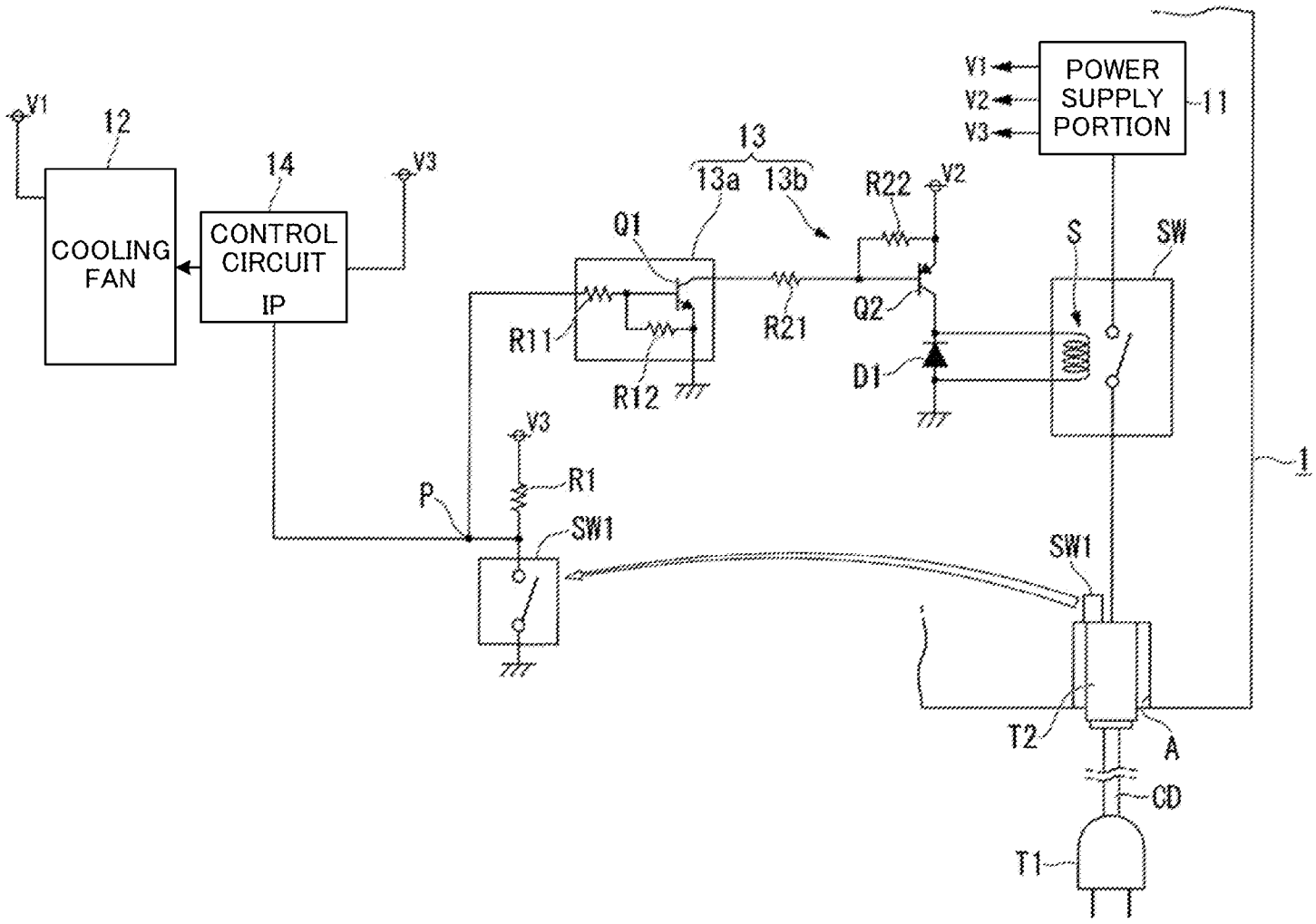
FIG. 3 is a circuit diagram showing a configuration of major parts of the multifunction peripheral as the image forming apparatus according to the first embodiment of the present disclosure.

FIG. 3 is a circuit diagram showing a configuration of major parts of the multifunction peripheral as the image forming apparatus according to the first embodiment of the present disclosure. It should be noted that in FIG. 3, components that are the same as those shown in FIGS. 1 and 2 are designated by the same reference characters. As shown in FIG. 3, the multifunction peripheral 1 includes a power supply portion 11, a cooling fan 12 (driving portion), a switch drive circuit 13 (control portion), a control circuit 14 (control portion), and the like in addition to the above-described insertion slot A, main power switch SW, and detection switch SW1.

As shown, the main power switch SW is connected between the power supply portion 11 and a connection terminal that is provided within the insertion slot A and is not shown (a terminal electrically connected to the power cord CD when the power cord CD is inserted into the insertion slot A). A plug T1 of the power cord CD is connected to an outlet which is not shown. In addition, the main power switch SW is connected between an external power supply (an AC commercial power supply having a voltage of 100 [V]) and the power supply portion 11 when a socket T2 of the power cord CD is inserted into the insertion slot A of the multifunction peripheral 1.

Furthermore, the main power switch SW includes a solenoid S therein as shown. The solenoid S is able to switch the main power switch SW from the ON state to the OFF state by internal control of the multifunction peripheral 1, not by an operation of the user. Although details will be described later, in the present embodiment, in the case where the main power switch SW is in the ON state, when the power cord CD is pulled out (the socket T2 of the power cord CD is removed from the insertion slot A), the main power switch SW is switched from the ON state to the OFF state by internal control of the multifunction peripheral 1.

As shown in FIG. 3, the detection switch SW1 is mounted at the insertion slot A. The detection switch SW1 is electrically connected at one end thereof to a resistor R1 and is grounded at the other end thereof. It should be noted that in FIG. 3, for convenience of illustration, two detection switches SW1 are shown, but these switches are the same. As described above, the detection switch SW1 is a switch that becomes the ON state or OFF state by insertion/non-insertion of the power cord CD with respect to the insertion slot A. Thus, the detection switch SW1 is able to detect a cut-off state of the external power supply with respect to the power supply portion 11.

The power supply portion 11 is connected to the external power supply and generates DC voltages V1 to V3 that are used in the multifunction peripheral 1. For example, the power supply portion 11 generates a DC voltage V1 of 24 [V], generates a DC voltage V2 of 5 [V], and generates a DC voltage V3 of 3.3 [V]. Here, the method by which the power supply portion 11 generates the DC voltages V1 to V3 is any method. For example, the power supply portion 11 may independently generate DC voltages V1 to V3. In addition, the power supply portion 11 may initially generate a DC voltage V1 and may generate DC voltages V2 and V3 by using the generated DC voltage V1.

The cooling fan 12 is, for example, a fan capable of cooling the power supply portion 11 or the control circuit 14. The cooling fan 12 uses, as power, the DC voltage V1 generated by the power supply portion 11, and is driven (rotates) by control of the control circuit 14. The switch drive circuit 13 is connected to a connection point P of the detection switch SW1 and the resistor R1. In addition, the switch drive circuit 13 is connected to the solenoid S of the main power switch SW. When a voltage at the connection point P becomes equal to or higher than a predetermined voltage Vt (e.g., 2.85 [V], the switch drive circuit 13 drives the main power switch SW to switch the main power switch SW from the ON state to the OFF state.

Specifically, the switch drive circuit 13 includes: an input circuit 13*a* connected to the above connection point P; and a drive circuit 13*b* connected to the solenoid S of the main power switch SW. The input circuit includes an NPN type transistor Q1 whose emitter terminal is grounded, a resistor R11, and a resistor R12. The resistor R11 is connected at one end thereof to the above connection point P and is connected at the other end thereof to the base terminal of the transistor Q1. The resistor R12 is connected between the base terminal and the emitter terminal of the transistor Q1.

In addition, the drive circuit 13*b* includes a PNP type transistor Q2 having an emitter terminal to which the DC voltage V2 is supplied, a resistor R21, a resistor R22, and a diode D1. The resistor R21 is connected at one end thereof to the collector terminal of the transistor Q1 and is connected at the other end thereof to the base terminal of the transistor Q2. The resistor R22 is connected between the base terminal and the emitter terminal of the transistor Q2. The anode electrode of the diode D1 is grounded, and the cathode electrode of the diode D1 is connected to the collector terminal of the transistor Q2. It should be noted that the solenoid S of the main power switch SW is connected between the anode electrode and the cathode electrode of the diode D1. In other words, the drive circuit 13*b* drives the main power switch SW with, as power, the DC voltage V2 generated by the power supply portion 11.

The control circuit 14 uses, as power, the DC voltage V3 generated by the power supply portion 11, and controls operation of the multifunction peripheral 1. The control circuit 14 includes a CPU (central processing unit) and comprehensively controls operation of the multifunction peripheral 1 in accordance with operation signals outputted from the operation display panel 1*c* or various instructions outputted from a communication portion which is not shown. For example, the control circuit 14 performs control of reading image data by the scanner portion 1*b*, control of receiving image data at the communication portion which is not shown, control of printing the image data, and the like. In addition, when the detection switch SW1 becomes the OFF state and the voltage at the connection point P becomes the DC voltage V3 (when an "H (high)" level signal is inputted to an input port IP of the control circuit 14), the control circuit 14 performs control so as to drive the cooling fan 12.

Figure 4:
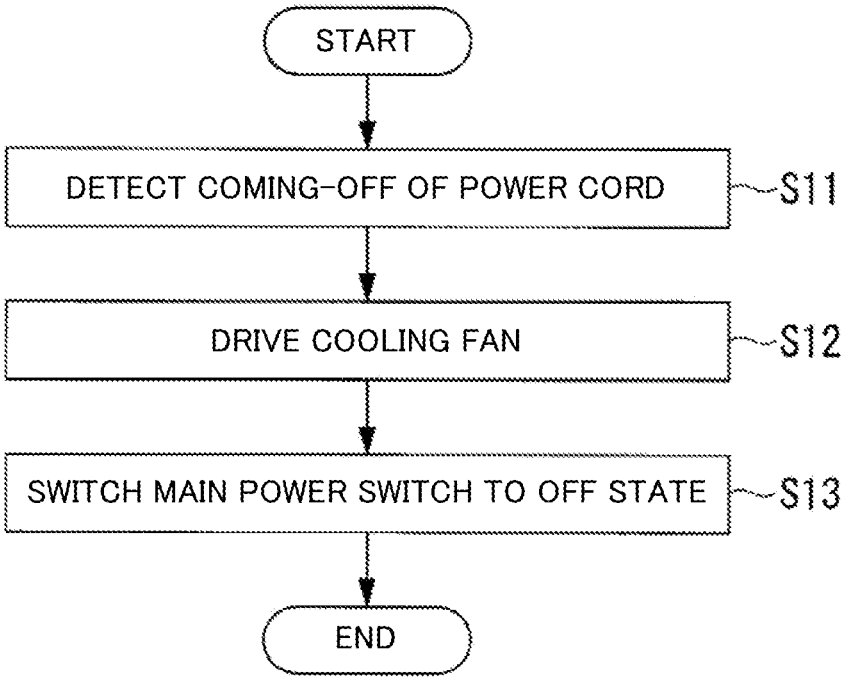
FIG. 4 is a flowchart showing an electric charge eliminating method according to the first embodiment of the present disclosure.
Figure 5:
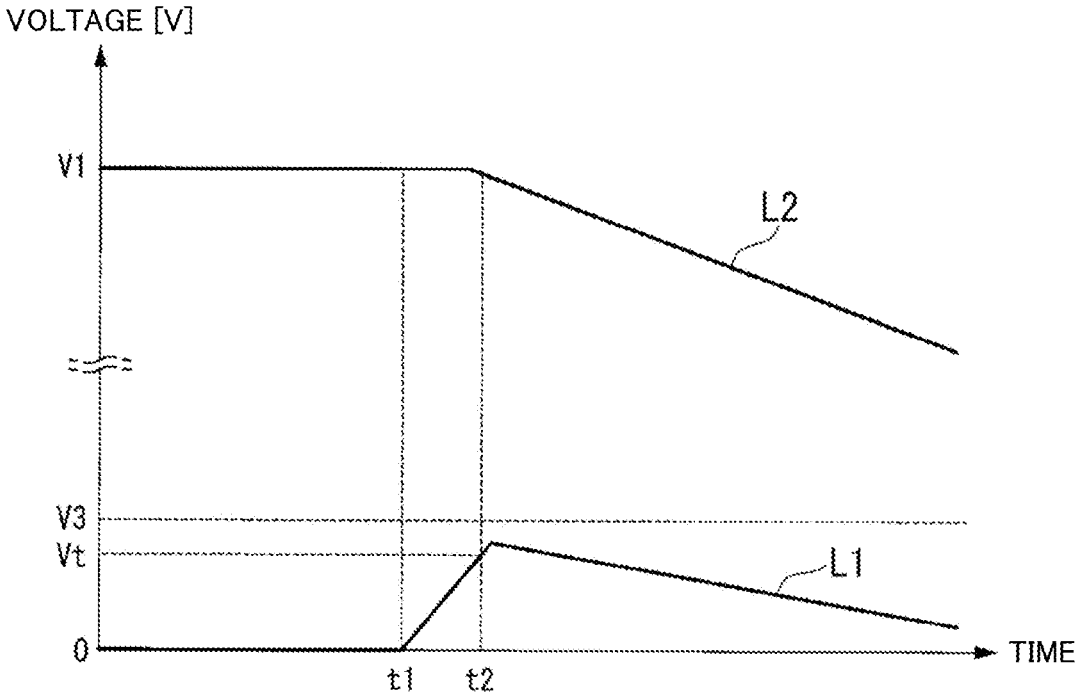
FIG. 5 is a diagram showing voltage change within the multifunction peripheral as the image forming apparatus according to the first embodiment of the present disclosure.

Next, operation of the multifunction peripheral 1 having the above configuration will be described. FIG. 4 is a flowchart showing an electric charge eliminating method according to the first embodiment of the present disclosure, and FIG. 5 is a diagram showing voltage change within the multifunction peripheral as the image forming apparatus according to the first embodiment of the present disclosure. It should be noted that in FIG. 5, a curved line designated by a reference character L1 represents change in the voltage at the connection point P (see FIG. 3), and a curved line designated by a reference character L2 represents change in the DC voltage V1 outputted from the power supply portion 11.

Here, it is assumed that the socket T2 of the power cord CD (the power cord CD whose plug T1 is connected to an outlet which is not shown) is inserted into the insertion slot A of the multifunction peripheral 1 and the main power switch SW of the multifunction peripheral 1 is in the ON state. Since the socket T2 of the power cord CD is inserted into the insertion slot A of the multifunction peripheral 1, the detection switch SW1 is in the ON state. Thus, as shown by the curved line L1 in FIG. 5, in an initial state (at a point before a time t1), the voltage at the connection point P is a ground voltage (0 [V]).

As shown in FIG. 4, in the multifunction peripheral 1, detection of coming-off of the power cord CD (a cut-off state of the external power supply with respect to the power supply portion 11) is performed (step S11: a first step). Specifically, detection of an increase in the voltage at the connection point P that is caused by the detection switch SW1 becoming an open state is performed. It should be noted that the process in step S11 is continued when coming-off of the power cord CD is not detected.

Here, it is assumed that at the time t1 in FIG. 5, the socket T2 of the power cord CD is removed from the insertion slot A of the multifunction peripheral 1. If so, the detection switch SW1 becomes the OFF state from the ON state, and hence the voltage at the connection point P rapidly increases as shown by the curved line L1 in FIG. 5. Thus, an "H" level signal is inputted to the input port IP of the control circuit 14, and the cooling fan 12 is driven by the control circuit 14 (step S12: a second step). It should be noted that even when the power cord CD comes off, the control circuit 14 is able to operate since the DC voltage V3 is maintained by electric charge remaining within the multifunction peripheral 1.

In addition, when the voltage at the connection point P rapidly increases to be equal to or higher than the predetermined voltage Vt (e.g., 2.85 [V]), the main power switch SW is driven and switched from the ON state to the OFF state by the switch drive circuit 13 (step S13: a third step). It should be noted that even when the power cord CD comes off, the driving of the main power switch SW by the switch drive circuit 13 is enabled since the DC voltage V2 is maintained by the electric charge remaining within the multifunction peripheral 1.

As a result of execution of steps S12 and S13, a state is provided in which the main power switch SW is switched to the OFF state and the cooling fan 12 is driven. Since the cooling fan 12 uses, as power, the DC voltage V1 generated by the power supply portion 11, when the cooling fan 12 is driven, the electric charge remaining within the multifunction peripheral 1 (electric charge remaining on a path through which the DC voltage V1 is supplied) is consumed. Thus, the DC voltage V1 decreases as shown by the curved line L2 in FIG. 5. It should be noted that in the case where the power supply portion 11 generates the DC voltage V3 by using the DC voltage V1, the DC voltage V3 also decreases with decrease in the DC voltage V1.

As described above, in the present embodiment, coming-off of the power cord CD is detected by the detection switch SW1. In addition, when coming-off of the power cord CD is detected, the cooling fan 12 is driven and the main power switch SW is switched from the ON state to the OFF state. In other words, in the present embodiment, a cut-off state of the external power supply with respect to the power supply portion 11 is detected, and when a cut-off state of the external power supply is detected, control is performed in which the driving portion, which drives with, as power, the DC voltage generated by the power supply portion 11, is driven. Thus, when power supply is stopped, electric charge remaining within the multifunction peripheral 1 is quickly eliminated. In addition, cooling within the multifunction peripheral 1 is continued by the cooling fan 12 being driven, and thus breakage of a semiconductor device due to temperature increase is prevented.

In addition, since the electric charge is quickly eliminated, breakage due to power being supplied again in a state where electric charge remains is prevented. Furthermore, since the main power switch SW is automatically switched from the ON state to the OFF state, occurrence of wasteful power consumption is prevented when the power cord CD is inserted into the insertion slot A of the multifunction peripheral 1 next time.

[Second Embodiment]

Figure 6:
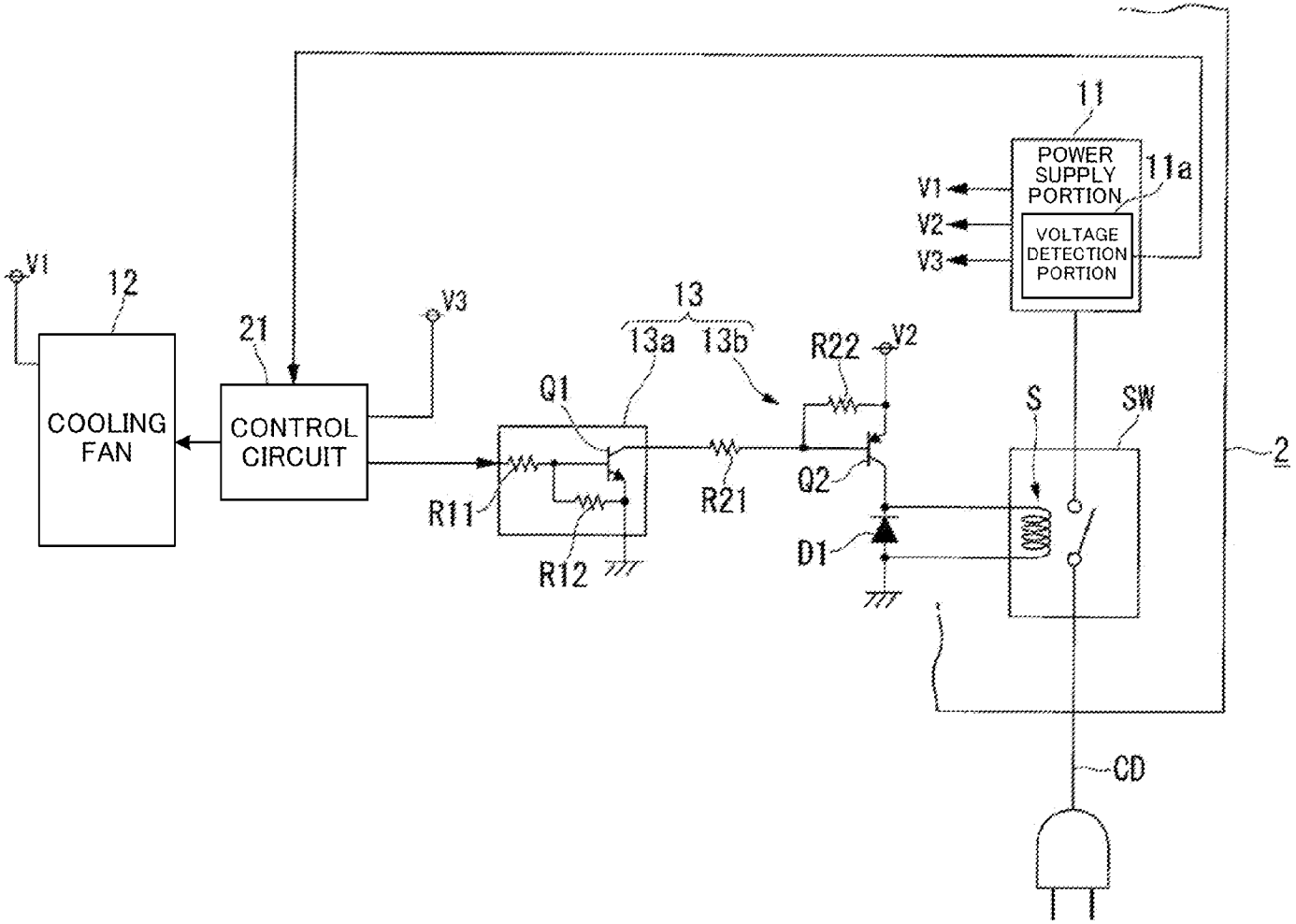
FIG. 6 is a circuit diagram showing a configuration of major parts of a multifunction peripheral as an image forming apparatus according to a second embodiment of the present disclosure.

FIG. 6 is a circuit diagram showing a configuration of major parts of a multifunction peripheral as an image forming apparatus according to a second embodiment of the present disclosure. It should be noted that in FIG. 6, components that are the same as those shown in FIG. 3 are designated by the same reference characters. As shown in FIG. 6, the multifunction peripheral 2 has a configuration in which the insertion slot A, the detection switch SW1, and the resistor R1 which are included in the multifunction peripheral 1 shown in FIG. 3 are omitted, a voltage detection portion 11*a* is provided in the power supply portion 11, and a control circuit 21 (control portion) is provided instead of the control circuit 14.

The multifunction peripheral 1 shown in FIG. 3 detects coming-off (non-insertion) of the power cord CD by the detection switch SW1, thereby detecting a cut-off state of the external power supply with respect to the power supply portion 11. Meanwhile, the multifunction peripheral 2 shown in FIG. 6 detects that the DC voltage V1 generated by the power supply portion 11 becomes equal to or lower than a predetermined threshold voltage, thereby detecting a cut-off state of the external power supply with respect to the power supply portion 11.

The voltage detection portion 11*a* provided in the power supply portion 11 detects that the DC voltage V1 generated by the power supply portion 11 becomes equal to or lower than the above threshold voltage. Here, the above threshold voltage is set at a voltage lower than a minimum voltage of the DC voltage V1 that is allowed when the multifunction peripheral 2 normally operates. In other words, the above threshold voltage is set at a low voltage that is conceivable to be generated only when the external power supply becomes a cut-off state.

Similarly to the control circuit 14 shown in FIG. 3, the control circuit 21 uses, as power, the DC voltage V3 generated by the power supply portion 11, and controls operation of the multifunction peripheral 2. It should be noted that the control circuit 14 shown in FIG. 3 performs only control so as to drive the cooling fan 12 when a cut-off state of the external power supply is detected, but the control circuit 21 performs control so as to drive the cooling fan 12 and also control so as to drive the switch drive circuit 13.

The multifunction peripheral 2 having the above configuration basically performs the same operation as that of the above-described multifunction peripheral 1 according to the first embodiment, except that a cut-off state of the external power supply is detected by the voltage detection portion 11*a* and that when a cut-off state of the external power supply is detected, the control circuit 21 performs control so as to drive the switch drive circuit 13 in addition to the cooling fan 12. Thus, the detailed description of the operation is omitted here.

As described above, in the present embodiment, a decrease in the DC voltage V1 is detected by the voltage detection portion 11*a*. In addition, when a decrease in the DC voltage V1 is detected, the cooling fan 12 is driven and also the main power switch SW is switched from the ON state to the OFF state. Thus, when power supply is stopped, electric charge remaining within the multifunction peripheral 2 is quickly eliminated. In addition, cooling within the multifunction peripheral 2 is allowed to be continued by the cooling fan 12 being driven, and thus breakage of a semiconductor device due to temperature increase is prevented. Moreover, breakage due to power being supplied again in a state where electric charge remains is prevented.

While the image forming apparatuses and the electric charge eliminating methods according to the embodiments of the present disclosure have been described above, the present disclosure is not limited to the above-described embodiments and changes may be freely made within the scope of the present disclosure. For example, in the above-described first and second embodiments, the cooling fan 12 is driven and also the main power switch SW is switched from the ON state to the OFF state. However, the switching of the main power switch SW from the ON state to the OFF state may be omitted, and the cooling fan 12 may be merely driven.

In addition, the above-described first and second embodiments may be combined. When coming-off of the power cord CD is detected by the detection switch SW1 or when a decrease in the DC voltage V1 is detected by the voltage detection portion 11*a*, driving of the cooling fan 12 and/or switching of the main power switch SW may be performed. Moreover, the cooling fan 12 is driven in the above-described embodiments, but a motor may be driven instead of the cooling fan 12 (or together with the cooling fan 12). Here, the driven motor is, for example, a conveyance motor that conveys a paper sheet as a recording medium, or the like.

In addition, in the above-described second embodiment, a cut-off state of the external power supply with respect to the power supply portion 11 is detected by detecting that the DC voltage V1 generated by the power supply portion 11 becomes equal to or lower than the predetermined threshold voltage. However, a cut-off state of the external power supply with respect to the power supply portion 11 may be detected by detecting that a voltage inputted to the power supply portion 11 becomes equal to or lower than a predetermined threshold voltage.

In addition, in the above-described embodiments, the case where the image forming apparatus according to the present disclosure is a multifunction peripheral has been described as an example. However, the present disclosure is also applicable to image forming apparatuses such as a printer, a copying machine, a facsimile, and the like.

It is to be understood that the embodiments herein are illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An image forming apparatus comprising:

a power supply portion connected to an external power supply and configured to generate a DC voltage;

a driving portion configured to use, as power, the DC voltage generated by the power supply portion;

a detection portion configured to detect a cut-off state of the external power supply with respect to the power supply portion;

a control portion configured to perform control so as to drive the driving portion when the cut-off state of the external power supply is detected by the detection portion; and a power switch connected between the external power supply and the power supply portion, wherein the driving portion includes:

a cooling fan configured to cool the power supply portion or the control portion; and a solenoid configured to switch the power switch from an ON state to an OFF state, and when the cut-off state of the external power supply is detected by the detection portion, the control portion controls the solenoid to switch the power switch to the OFF state and drives the cooling fan.

2. The image forming apparatus according to claim 1, further comprising an insertion portion into which a power cord connected to the external power supply is inserted, wherein the detection portion includes a detection switch configured to detect insertion or non-insertion of the power cord with respect to the insertion portion, and detects the cut-off state of the external power supply by detecting the non-insertion of the power cord by the detection switch.

3. The image forming apparatus according to claim 1, wherein the detection portion includes a voltage detection portion configured to detect whether the DC voltage generated by the power supply portion becomes equal to or lower than a predetermined threshold voltage, and detects the cut-off state of the external power supply by detecting, by the voltage detection portion, that the DC voltage generated by the power supply portion becomes equal to or lower than the threshold voltage.

4. An electric charge eliminating method for eliminating electric charge from an image forming apparatus configured to form an image on a recording medium, the electric charge eliminating method comprising:

a first step of detecting a cut-off state of an external power supply with respect to a power supply portion configured to generate a DC voltage; and a second step of performing control so as to drive a driving portion configured to use, as power, the DC voltage generated by the power supply portion, when the cut-off state of the external power supply with respect to the power supply portion is detected in the first step, wherein performing control so as to drive the driving portion includes controlling a solenoid to switch a power switch to an OFF state and driving a cooling fan to cool the power supply portion or a control portion.

* * * * *